US007742912B2

(12) United States Patent
Den Brinker

(10) Patent No.: US 7,742,912 B2
(45) Date of Patent: Jun. 22, 2010

(54) METHOD AND APPARATUS TO ENCODE AND DECODE MULTI-CHANNEL AUDIO SIGNALS

(75) Inventor: Albertus Cornelis Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 765 days.

(21) Appl. No.: 11/570,522

(22) PCT Filed: Jun. 14, 2005

(86) PCT No.: PCT/IB2005/051964

§ 371 (c)(1),
(2), (4) Date: Dec. 13, 2006

(87) PCT Pub. No.: WO2006/000952

PCT Pub. Date: Jan. 5, 2006

(65) Prior Publication Data

US 2007/0248157 A1 Oct. 25, 2007

(30) Foreign Application Priority Data

Jun. 21, 2004 (EP) ..... 04102827

(51) Int. Cl.
*G10L 19/00* (2006.01)
*G10L 21/00* (2006.01)

(52) U.S. Cl. ..... 704/200.1; 704/500; 704/219

(58) Field of Classification Search ..... 704/219, 704/500, 503; 375/240
See application file for complete search history.

(56) References Cited

U.S. PATENT DOCUMENTS

| | | | | |
|---|---|---|---|---|
| 5,812,971 | A | 9/1998 | Herre | |
| 6,266,368 | B1 | 7/2001 | Bruekers | |
| 6,393,392 | B1 | 5/2002 | Minde | |
| 6,539,357 | B1 * | 3/2003 | Sinha | 704/270.1 |
| 7,263,480 | B2 * | 8/2007 | Minde et al. | 704/219 |

FOREIGN PATENT DOCUMENTS

| | | | |
|---|---|---|---|
| JP | 2000066700 | A | 3/2000 |
| JP | 2001188565 | A | 7/2001 |
| WO | WO03085645 | A1 | 10/2003 |

OTHER PUBLICATIONS

International Search Report of International Application No. PCT/IB2005/051964 Contained in International Publication No. WO2006000952.

(Continued)

*Primary Examiner*—Talivaldis Ivars Smits
*Assistant Examiner*—Shaun Roberts

(57) ABSTRACT

An encoder (100) for encoding a multi-channel audio signal comprises a prediction processor (101) for generating two residual signals for two signal components of the multi-channel signal by linear prediction which is associated with psycho-acoustic characteristics and which specifically uses psycho-acoustic prediction filters; a rotation processor (105) for rotating the combined signal of the two residual signals to generate a main signal and a side signal, in which the energy of the main signal is maximized and the energy of the side signal is minimized; an encoding processor (109) for encoding the main and preferably the side signal; and an output processor (111) for generating an output signal data, prediction parameters and rotation parameters.

18 Claims, 6 Drawing Sheets

OTHER PUBLICATIONS

Written Opinion of the International Searching Authority for International Application No. PCT/IB2005/051964.

Fuchs, H.: "Improving Joint Stereo Audio Coding by Adaptive Inter-Channel Prediction"; IEEE Workshop on Applications of Signal Processing to Audio and Acoutics, Oct. 17, 1993, pp. 39-42, XP000570718.

Harma et al: "An Experimental Audio Codec Based on Warped Linear Predition of Complex Valued Signals"; Acoustics, Speech, and Signal Processing, 1997. ICASSP-97., 1997 IEEE International Conference in Munich, Germany, Apr. 21-24, 1997, IEEE Comput. Society, Apr. 21, 1997, pp. 323-326, XP010226200.

Smith et al: "Bark and Erb Biliniear Transform" IEEE Trans. Speech and Audio Processing, vol. 7, pp. 697-708, 1999.

* cited by examiner

METHOD AND APPARATUS TO ENCODE AND DECODE MULTI-CHANNEL AUDIO SIGNALS

FIELD OF THE INVENTION

The invention relates to a multi-signal encoder, a multi-signal decoder and methods therefore and in particular, but not exclusively, to encoding of stereo audio signals.

BACKGROUND OF THE INVENTION

In recent years, the distribution and storage of content signals in digital form has increased substantially. Accordingly, a large number of encoding standards and protocols have been developed.

One of the most widespread coding standards for digital audio encoding of audio signals is the Motion Picture Expert Group Level 3 standard generally referred to as MP3. As an example, MP3 allows, a 30 or 40 megabyte digital PCM (Pulse Code Modulation) audio recording of a song to be compressed into e.g. a 3 or 4 megabyte MP3 file. The exact compression rate depends on the desired quality of the MP3 encoded audio.

Audio encoding and compression techniques such as MP3 provide for very efficient audio encoding which allows audio files of relatively low data size and high quality to be conveniently distributed through data networks such as the Internet.

Many encoding protocols provide for efficient encoding of stereo channels. Stereo coding aims at removing redundancy and irrelevancy from the stereo signal to attain lower bit rates than the sum of the bit rates of the separate channels for a given quality level.

A number of different stereo encoding algorithms and techniques are known. One technique is known as intensity stereo coding. Intensity stereo coding allows a great reduction in bit rate compared to independent coding of audio channels. In intensity stereo, a mono audio signal is generated for the higher frequency range of the signal. In addition, separate intensity parameters are generated for the different channels. Typically, the intensity parameters are in the form of left and right scale factors which are used in the decoder to generate the left and right output signals from the mono audio signal. A variation is the use of a single scale factor and a directional parameter.

The intensity stereo coding technique has however several disadvantages. First of all, the encoder discards time- and phase information for the higher frequencies. The decoder therefore cannot reproduce the time- or phase channel differences that are present in the original audio material. Furthermore, in general, the encoding cannot preserve the correlation between the audio channels. Accordingly, a quality degradation of the stereo signal generated by the encoder cannot be avoided.

Another technique is known as Mid/Side (MS) coding wherein a Mid signal component may be generated by adding the left and right channel signals and the Side channel may be generated by subtracting the left and right channel signals. As the correlation between the left and right signals typically is high, this usually results in a high signal energy of the Mid signal component and a low signal energy of the Side signal. The Mid and Side signals are then encoded using different encoding parameters where the encoding of the Side signal is typically such that it reduces the data rate for the Side signal.

A disadvantage of MS coding is that the bit rate efficiency of MS coding is generally significantly lower than for example intensity stereo encoding thereby resulting in increased data rates. In a worst case situation, MS coding does not provide any gain in bit rate compared to independent coding of left and right channels.

Another stereo encoding technique is known as linear prediction techniques wherein the left and right channels are linearly combined into a complex signal. A complex linear prediction filter is then used to predict the complex signal and the resulting residual signal is encoded. An example of such an encoder is given in "An experimental audio codec based on warped linear prediction of complex valued signals" by Härmä, Laine and Karjalainen, Proceedings of ICASSP-97, page 323-326 Munich Germany, April 1997.

A problem associated with the current linear prediction proposals is that combining the left and right channels into a complex signal imposes a temporal association of the left and right channels which results in a limitation in the available degrees of freedom for the prediction. Accordingly, the prediction is not able to attain maximum removal of redundant information. Furthermore, the techniques do not identify or construct a main and side signal for which encoding can be individually optimized. Additionally, the prediction criteria used are based on simple prediction filtering which do not result in optimal prediction. Accordingly, the achievable data rate for a given signal quality is not optimal.

A different encoding technique utilizes a rotation of frequency bands or subbands. In such a technique bandfilters may be used to generate a plurality of subband signals for the left and right channel. Each subband of one channel is paired with a subband of the other channel and a principal component analysis is performed. The parameters per subband are applied in the encoder to generate a main and side signal per subband by rotation. The parameters are also stored in the data stream such that the decoder can apply the inverse process.

A problem with such a rotator technique is that it does not take into account possible time-differences between the left and right signal and accordingly does not achieve optimum performance. Secondly, due to overlap-add analysis and synthesis, perfect reconstruction of the subband signals is not possible even in the absence of signal quantisation.

Currently, the most promising technique for low data rate stereo encoding appears to be perceptual stereo coding in which perceptual models and information is used to reduce the encoded data rate. Thus, rather than attempting to represent the waveform of the original stereo signal as closely as possible, perceptual stereo encoding aims at generating a signal that the decoder can use to generate an output signal that results in the same audio perception for a user.

A problem which is inherent in this approach is that even in the absence of signal quantisation, the original signal can not be reconstructed perfectly. This may in particular be due to the overlap-add procedures which are used in the analysis and synthesis systems. Accordingly, for high data rate applications, the performance of perceptual stereo encoding tends to provide a lower quality of the reconstructed signal.

Accordingly an improved system for multi-channel encoding and/or decoding would be advantageous and in particular a system allowing increased flexibility, reduced data rate, increased quality and/or reduced complexity would be advantageous. Specifically, a system allowing high signal quality at high data rates and efficient encoding at low data rates would be advantageous.

SUMMARY OF THE INVENTION

Accordingly, the Invention preferably seeks to mitigate, alleviate or eliminate one or more of the above mentioned disadvantages singly or in any combination.

According to a first aspect of the invention, there is provided a signal encoder for encoding a multi-channel signal comprising at least a first signal component and a second signal component, the signal encoder comprising: predicting means for generating a first residual signal of the first signal component and a second residual signal of the second signal component by linear prediction of the first signal component and the second signal component, the linear prediction being associated with psycho-acoustic characteristics; rotation means for generating a main signal and a side signal by rotation of a combined signal comprising the first residual signal and the second residual signal, the main signal having a higher signal energy than the side signal; first encoding means for encoding the main signal to generate encoded main data; and output means for generating an output signal comprising the encoded main data.

The invention may provide for an improved quality at a given data rate and/or a reduced data rate for a given quality level. Alternatively or additionally, the invention may provide for a signal encoder having improved flexibility and/or improved performance over a range of data rates. In particular, the invention may generate a main and side signal suitable for efficient encoding at low data rates while providing an encoding scheme allowing an accurate representation of the waveform of the original signal at high data rates.

The invention may allow the advantages of different encoding approaches to be combined to overcome disadvantages associated with the individual encoding schemes. In particular, the invention may provide an increased number of degrees of freedom for the prediction thereby reducing the magnitude of the residual signals. Furthermore, an improved prediction for audio signals may be achieved by using a prediction based on a psycho-acoustic characteristic. The psycho-acoustic characteristic is indicative of the perception of the audio signal by a user. The combination of an improved prediction and rotation may reduce the data rate for a given quality level and may in particular generate a main signal and a side signal which can be individually encoded by an algorithm specifically suitable for the characteristics of the individual signal.

In particular an embodiment of the invention may provide a signal encoder which allows virtually perfect signal reconstruction in the absence of signal quantisation and accordingly near perfect signal reconstruction for high data rates. The same signal encoder may also construct a main and a side signal similar to those provided by parametric perceptual stereo coding which may be advantageous for low data rate encoding.

The encoding of the main signal may for example comprise quantisation of the main signal. The output means is preferably operable to further include the rotation parameter and/or prediction parameters of the linear prediction in the output signal.

According to preferred feature of the invention, the signal encoder further comprises second encoding means for encoding the side signal to generate encoded side data; and the output means is further operable to include the encoded side data in the output signal.

This may allow a decoder to regenerate a signal having a higher quality while maintaining a low data rate.

The data rate of the encoded main data signal is preferably higher than the data rate of the encoded side data. Preferably, a sample rate of the encoded main data is higher than a sample rate of the encoded side signal and/or the quantization of the encoded main data is finer than for the encoded side signal.

According to preferred feature of the invention, the second encoding means is operable to parametrically encode the side signal. This may provide an efficient encoding resulting in a low data rate of the output signal for a given quality level.

According to preferred feature of the invention, the prediction means comprises at least one psycho-acoustic based filter system.

This may provide an efficient prediction performance and/or facilitate implementation. The psycho-acoustic based filter system may for example be a Kautz filter bank, a Laguerre filter bank, a tapped allpass line or a Gamma-tone filter bank.

According to preferred feature of the invention, the rotation means is operable to rotate the combined signal to substantially maximize a signal energy of the main signal. This may provide for an efficient encoding of the multi-channel signal. In particular, it may increase the information in the main signal thereby allowing for an accurate encoding of the main signal to retain a high degree of information.

According to preferred feature of the invention, the rotation means is operable to rotate the combined signal to substantially minimize a signal energy of the side signal. This may provide for an efficient encoding of the multi-channel signal. In particular, it may decrease the relative information content of the side signal thereby allowing for the degradation to the output signal resulting from a lossy encoding of the side signal to be reduced. In particular, in embodiments where the side signal is discarded, the quality degradation associated therewith may be reduced.

According to preferred feature of the invention, the predicting means comprises: a first predictor for generating a first estimate signal for the first signal component in response to the first signal component; a second predictor for generating a second estimate signal for the first signal component in response to the second signal component; and means for generating the first residual signal as the first signal component subtracted by the first estimate signal and the second estimate signal.

This may provide a suitable implementation and/or result in accurate prediction and thus an improved ratio between the quality level and data rate of the output signal. In particular, the feature may allow for an independent prediction of the first signal component based on the first signal component and on the second signal component. The first and second predictor may specifically result different temporal predictions. The temporal independence between the first estimate signal and the second estimate signal provides increased degrees of freedom for the prediction resulting in improved performance.

Each of the first and/or second predictors may comprise a Finite Impulse Response (FIR) or an Infinite Impulse Response (IIR) filter and may in particular comprise a psycho-acoustic based filter bank.

According to preferred feature of the invention, the predicting means comprises: a third predictor for generating a third estimate signal for the second signal component in response to the first signal component; a fourth predictor for generating a fourth estimate signal for the second signal component in response to the second signal component; and means for generating the second residual signal as the second signal component subtracted by the third estimate signal and the fourth estimate signal.

This may provide a suitable implementation and/or result in accurate prediction and thus an improved ratio between the quality level and data rate of the output signal.

Each of the third and/or fourth predictor may comprise a Finite Impulse Response (FIR) or an Infinite Impulse Response (IIR) filter and may in particular comprise a psycho-acoustic based filter bank.

According to preferred feature of the invention, the rotator is operable to perform a matrix multiplication on the combined signal. This may provide a suitable implementation.

According to preferred feature of the invention, the signal encoder further comprises means for spectrally shaping the main signal in response to a spectral characteristic of the first signal component and the second signal component. Preferably the first encoding means comprises a psycho-acoustic mono encoder. This may result in an improved ratio between the quality level and data rate of the output signal.

The multi-channel signal may comprise any plurality of signal components but preferably the multi-channel signal is a stereo audio signal.

According to a second aspect of the invention, there is provided a signal decoder for decoding a multi-channel signal, the signal decoder comprising:

receiving means for receiving a multi-channel signal;

rotation means for generating a first residual signal and a second residual signal by rotation of the multi-channel signal;

synthesis means for generating an output multi-channel signal by linear prediction in response to the first residual signal and the second residual signal, the linear prediction being associated with psycho-acoustic characteristics.

According to a third aspect of the invention, there is provided a method of encoding a multi-channel signal comprising at least a first signal component and a second signal component, the method comprising the steps of: generating a first residual signal of the first signal component and a second residual signal of the second signal component by linear prediction of the first signal component and the second signal component, the linear prediction being associated with psycho-acoustic characteristics; generating a main signal and a side signal by rotation of a combined signal comprising the first residual signal and the second residual signal, the main signal having a higher signal energy than the side signal; encoding the main signal to generate encoded main data; and generating an output signal comprising the encoded main data.

According to a fourth aspect of the invention, there is provided a method of decoding a multi-channel signal, the method comprising the steps of: receiving a multi-channel signal; generating a first residual signal and a second residual signal by rotation of the multi-channel signal; and generating an output multi-channel signal by linear prediction in response to the first residual signal and the second residual signal, the linear prediction being associated with psycho-acoustic characteristics.

According to a fifth aspect of the invention, there is provided a data stream, stored on a computer-readable storage medium, comprising encoded data for a multi-channel signal, the data stream comprising: linear prediction parameters indicative of a linear prediction of a first signal component and a second signal component of the multi-channel signal; a rotation parameter indicative of a rotation value between a main signal and a combined signal comprising a first residual signal associated with the linear prediction of the first signal component and a second residual signal associated with the linear prediction of the second signal component; and encoded main data of the main signal.

These and other aspects, features and advantages of the invention will be apparent from and elucidated with reference to the embodiment(s) described hereinafter.

BRIEF DESCRIPTION OF THE DRAWINGS

An embodiment of the invention will be described, by way of example only, with reference to the drawings, in which.

DESCRIPTION OF PREFERRED EMBODIMENTS

The following description focuses on an embodiment of the invention applicable to an encoder and a decoder for a stereo audio signal. However, it will be appreciated that the invention is not limited to this application but may be applied to many other multi-channel signals.

Figure 1:
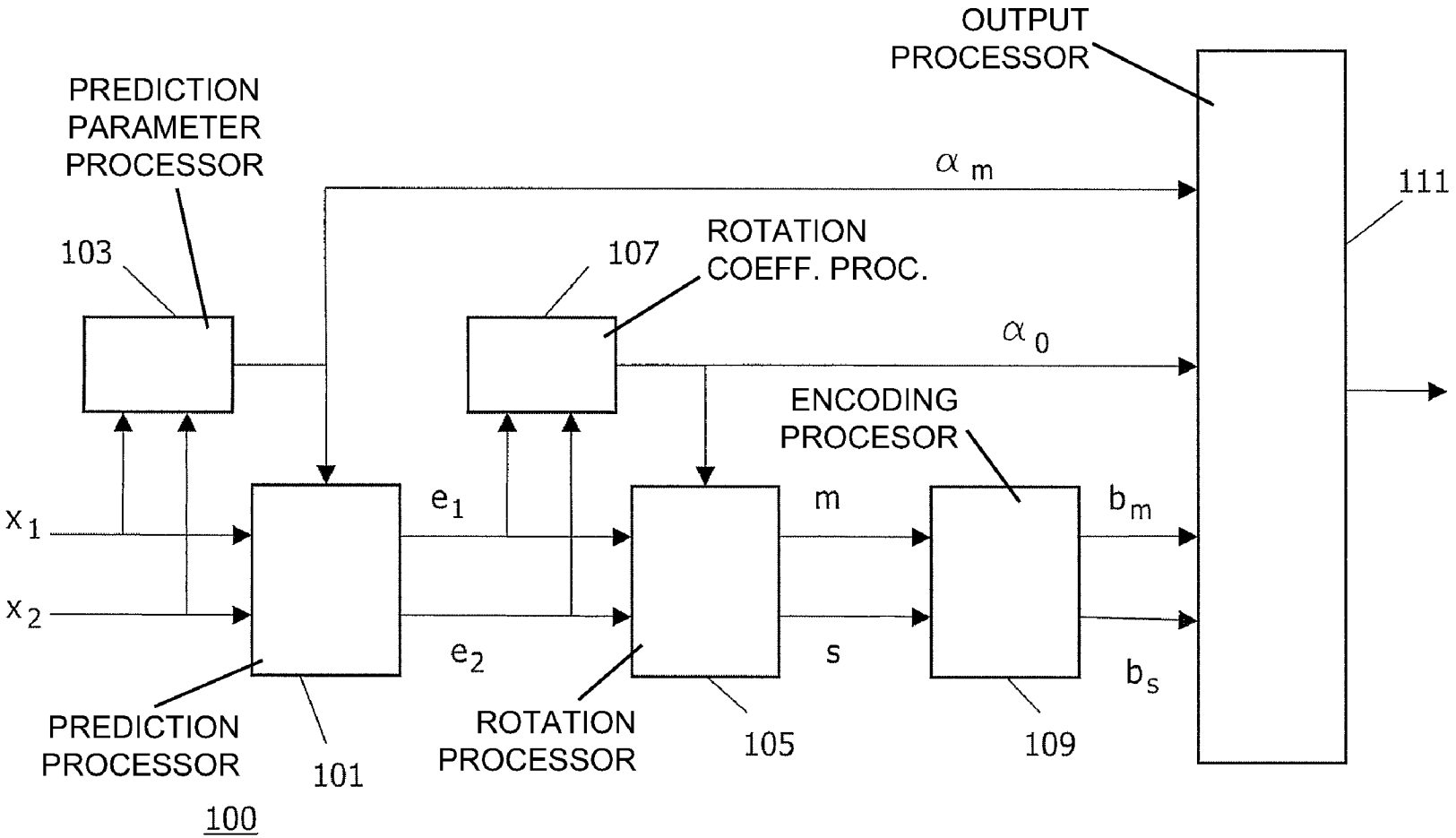
FIG. 1 illustrates an example of a block diagram for an encoder in accordance with an embodiment of the invention.

FIG. 1 illustrates an example of a block diagram for an encoder 100 in accordance with an embodiment of the invention.

The encoder 100 receives a stereo signal comprising a first signal component $x_1$ which in the described embodiment is the left channel signal and a second signal component $x_2$ which in the described embodiment is the right channel signal. The first and second signal components $x_1$, $x_2$ are fed to a prediction processor 101 which generates a first residual signal $e_1$ of the first signal component and a second residual signal $e_2$ of the second signal component by linear prediction of the first and second signal components $x_1$, $x_2$.

The first and second signal components $x_1$, $x_2$ are further fed to a prediction parameter processor 103 which determines the optimal prediction coefficients for the linear prediction performed by the prediction processor 101. Accordingly the prediction parameter processor 103 is coupled to the prediction processor 101 and feeds the determined prediction parameters to this. The prediction parameter processor 103 may determine the prediction parameters using known optimization algorithms such as linear regression as is well known to the person skilled in the art The prediction parameter processor 103 may further perform other standard linear prediction operations such as spectral smoothing (also known as peak-broadening) and interpolation of the prediction parameters. Typically the prediction parameter processor 103 will also include quantisation of the parameters.

Based on the prediction parameters received from the prediction parameter processor 103, the prediction processor 101 generates an expected value of the current left and right channel sample and subtracts this from the actual values of the first and second signal components $x_1$, $x_2$. Accordingly, the prediction processor 101 generates first and second residual signals $e_1$, $e_2$ which correspond to the difference between the predicted values and the actual values of the first and second signal components $x_1$, $x_2$. The values of the residual signals $e_1$, $e_2$ are typically of much lower value than the first and second signal components values.

The prediction processor 101 is operable to perform the linear prediction which takes into account the perception of audio by a human being. Thus, the linear prediction is associated with a psycho-acoustic characteristic. For example, the linear prediction may take into account the sensitivity of the human ear in different frequency ranges, the impulse performance and sensitivity to volume levels etc. The linear prediction may modify or change a parameter in dependence on the psycho-acoustic characteristic or the psycho-acoustic characteristic may e.g. be an inherent part of the design and implementation of the prediction processor 101. For example, the algorithm used may be selected to reflect a psycho-acoustic model of human hearing. In particular, the prediction processor 101 may use one or more psycho-acoustic based prediction systems such as a Kautz filter bank, Laguerre filter bank or Gamma-tone filter bank.

The prediction processor 101 is coupled to a rotation processor 105 which generates a main signal and a side signal by rotation of the combined signal comprising the first residual signal $e_1$ and the second residual signal $e_2$. The prediction processor 101 is furthermore coupled to a rotation coefficient processor 107 which determines the rotation coefficient which is used by the rotation processor 105. In the specific embodiment, the combined signal may be considered as a complex signal corresponding to $e_1+j\cdot e_2$ which is multiplied by a complex rotation value $a+j\cdot b$ thus resulting in main and side signals given by $$m+j\cdot s=(e_1+j\cdot e_2)\cdot(a+j\cdot b) \tag{1}$$

Equivalently, the rotation coefficient processor 107 may generate an angular value $\alpha_0$ which may be used in a matrix calculation performed by the rotation processor 105:

$$\begin{pmatrix} m \\ s \end{pmatrix} = \begin{pmatrix} \cos(\alpha_0) & \sin(\alpha_0) \\ -\sin(\alpha_0) & \cos(\alpha_0) \end{pmatrix} \cdot \begin{pmatrix} e_1 \\ e_2 \end{pmatrix} \tag{2}$$

In the embodiment, the rotation coefficient processor 107 determines the rotation parameter such that the main signal has higher signal energy than the side signal. This will generally allow the signal values of the main signal to be larger than the signal values of the side signal thereby providing for a concentration of information in the main signal. This may allow a more efficient encoding. Specifically, the quantisation and/or sample rate of the side signal may be reduced substantially. In some embodiments, the side signal may even be discarded completely.

In the described embodiment, the rotation coefficient processor 107 determines the rotation parameter such that the signal energy is maximized for the main signal and/or minimized for the side signal. For example, the angular value $\alpha_0$ is determined such that the main signal is maximized and the side signal is minimized.

The rotation processor 105 is coupled to an encoding processor 109 which encodes the main and side signal to generate encoded main data and preferably encoded side data. It will be appreciated that any suitable means of encoding the main and side signal may be used. In a simple embodiment, the encoding processor 109 may simple comprise a quantizer generating quantised data for the main and side signals ($b_m$, $b_s$) by individual quantization of the main and side signal.

In some embodiments, the side signal is parametrically encoded whereby, rather than including signal data values describing the waveform of the side signal, one or more parameters are included which describe one or more characteristics of the side signal. This may allow for a very efficient and low data rate encoding of the side signal.

The encoding processor 109 is coupled to an output processor 111 which generates an output signal comprising the encoded main data and preferably the side encoded data. In addition the output processor 111 in the described embodiment includes the prediction parameters used for the linear prediction as well as the rotation parameter. Accordingly, a single bitstream representing the stereo signal is generated.

The combination of linear prediction based on psycho-acoustic parameters with a rotation of the resulting residual signals provides for a highly efficient encoding with high flexibility. In particular, the generation of a main and side signals may provide a highly efficient encoding at the lower data rates. Furthermore, at high data rates the encoder generates a bitstream from which the original signal may be regenerated very accurately.

Figure 2:
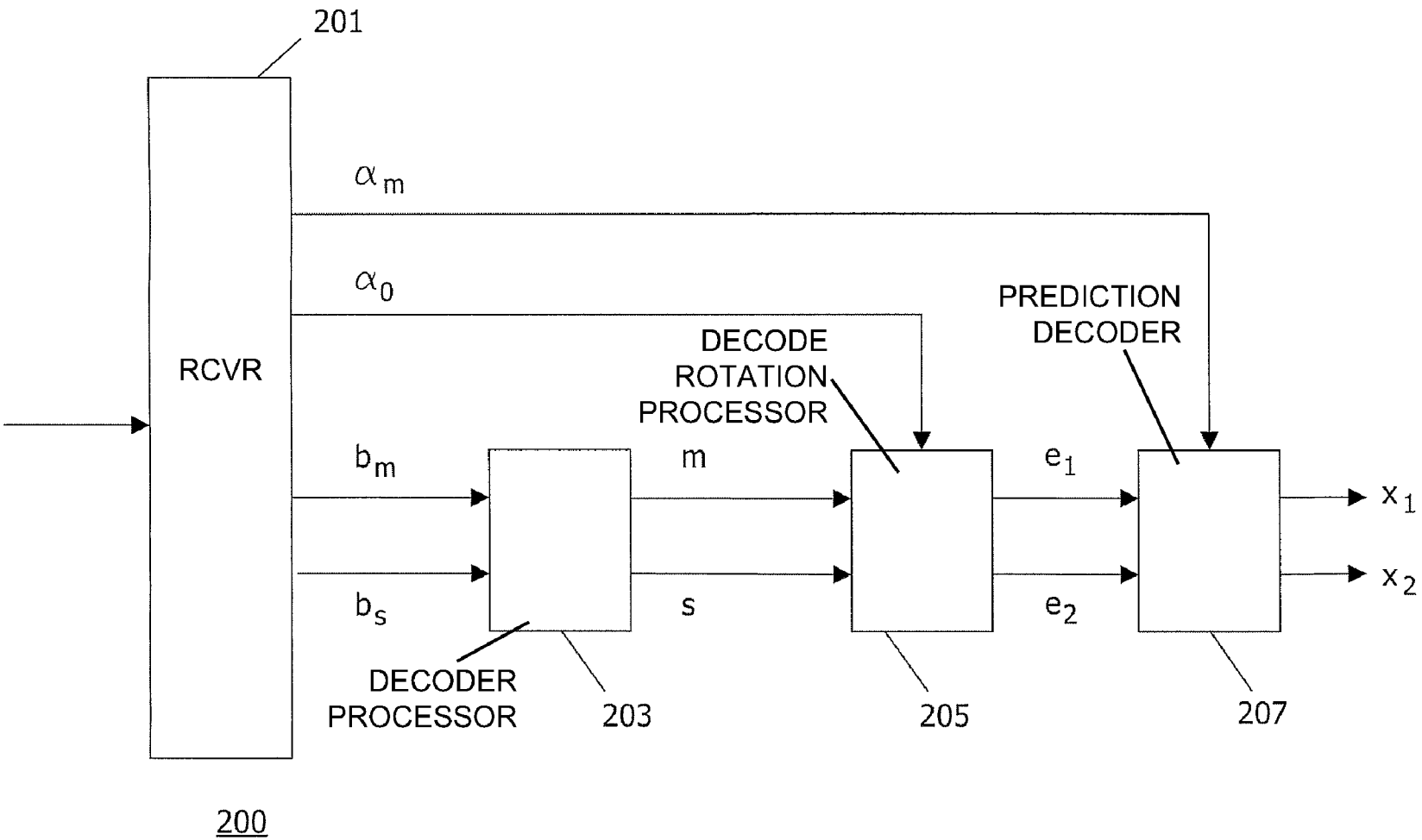
FIG. 2 illustrates an example of a block diagram for a decoder in accordance with an embodiment of the invention.

FIG. 2 illustrates an example of a block diagram for a decoder 200 in accordance with an embodiment of the invention. The decoder may decode the bitstream from the encoder of FIG. 1 and will be described with reference to this.

The decoder 200 comprises a receiver 201 which receives the multi-channel signal from the encoder 100 in the form of the bitstream generated by the encoder 100. The receiver 201 comprises a de-multiplexer which is operable to separate the data of the bitstream and to provide it to the appropriate functional blocks of the decoder 200.

The decoder 200 comprises a decoder processor 203 which generates the main and side signal from the bit stream. In particular, the receiver 201 feeds the encoded main and side data $b_m$, $b_s$ to the decoder processor 203 which performs the complementary operation to the encoding processor 109 of the encoder 100 of FIG. 1. In a simple embodiment, wherein the encoding processor 109 merely quantizes the data values from the rotation processor 105, the decoder processor 203 may simply forward the quantized values received in the encoded main and side data.

The decoder 201 furthermore comprises a decode rotation processor 205 which is coupled to the decoder processor 203. The decoder processor 203 feeds the received main and side signal to the decode rotation processor 205 which re-generates the first residual signal $e_1$ and the second residual signal $e_2$ by rotation of the main and side signal. In particular, the decode rotation processor 205 may perform the matrix operation:

$$\begin{pmatrix} e_1 \\ e_2 \end{pmatrix} = \begin{pmatrix} \cos(-\alpha_0) & \sin(-\alpha_0) \\ -\sin(-\alpha_0) & \cos(-\alpha_0) \end{pmatrix} \cdot \begin{pmatrix} m \\ s \end{pmatrix} \tag{4}$$

Accordingly, the decode rotation processor 205 is fed the value $\alpha_0$ from the receiver 201.

The decode rotation processor 205 is coupled to a prediction decoder 207. The prediction decoder 207 generates a first predicted signal for a first signal component of the multi-channel signal and a second predicted signal for a second signal component of the multi-channel signal by linear predictive filtering. The first and second predicted signals are generated to correspond to the predicted signals used by the prediction processor 101 to generate the residuals signals. In particular, the same prediction algorithm may be used based on the decoded signals. Accordingly, the prediction decoder 207 receives the prediction parameters $\alpha_m$ from the receiver 201.

Similarly to the encoder, the linear predictive filtering is based on suitable psycho-acoustic characteristics such as prediction filters which represent characteristics of psycho-acoustic perception of a human listener.

Based on the first predicted signal and the first residual signal $e_1$ the first signal component $x_1$ is re-generated by the prediction decoder 207. Similarly, the second signal component $x_2$ is generated based on the second predicted signal and the second residual signal.

It will be appreciated that although the above description focuses on an implementation wherein the prediction parameter and rotation parameter are included in the received data stream, this is not an essential feature of the invention.

For example, in some embodiments, these values may be constructed using backward adaptive algorithms.

In the following, aspects of the encoder 100 of FIG. 1 will be described in further detail.

Figure 3:
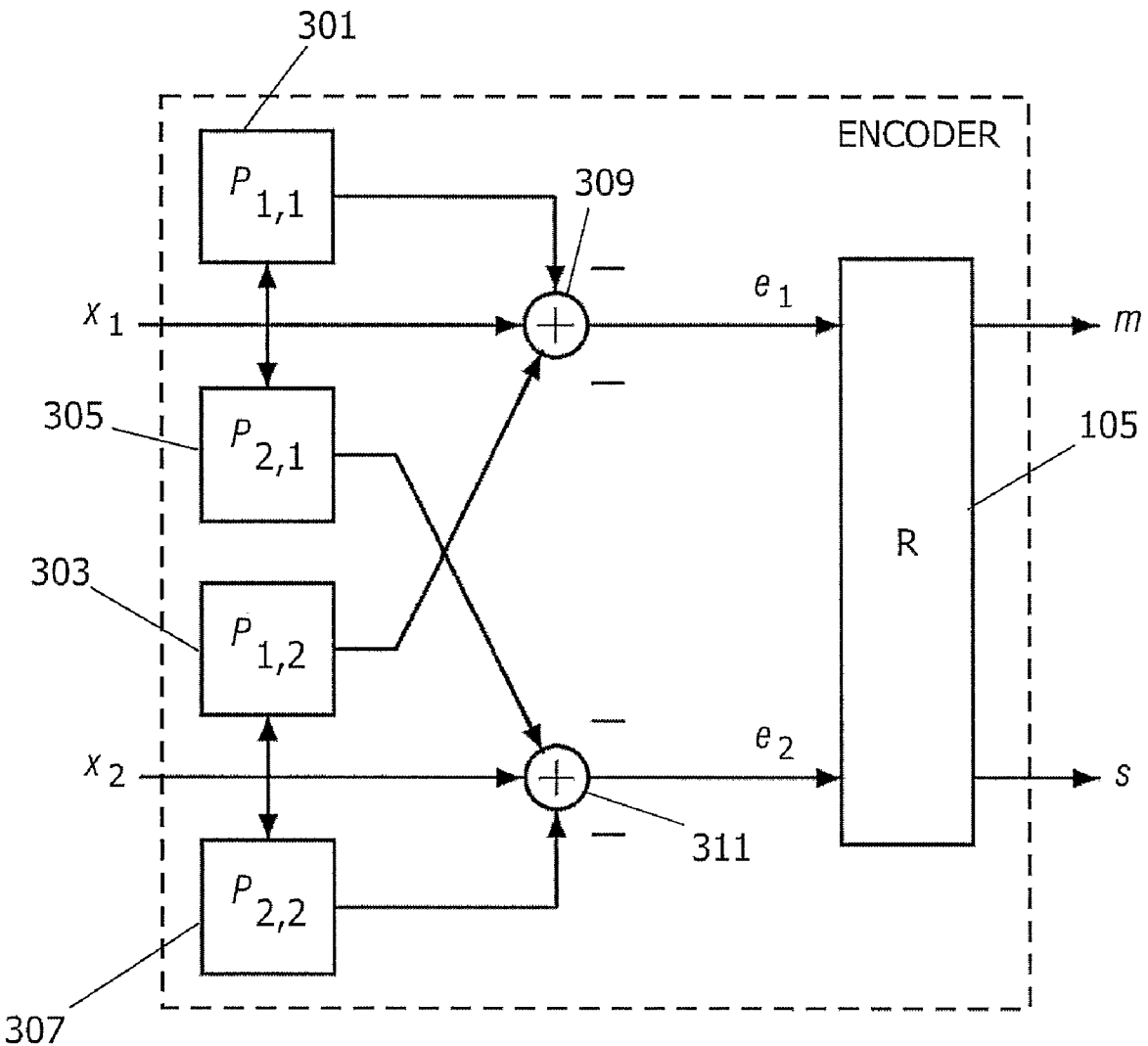
FIG. 3 illustrates an implementation of linear prediction and rotation means for an encoder in accordance with an embodiment of the invention.

FIG. 3 illustrates an implementation of linear prediction and rotation means in accordance with an embodiment of the invention. Specifically, the Figure illustrates an embodiment of the prediction processor 101 and rotation processor 105 of FIG. 1.

The first and second signal components $x_1$, $x_2$ are input to the prediction processor 101 which is a two-channel predictor yielding output signals $e_1$, $e_2$.

In the embodiment, the prediction processor 101 comprises four predictors 301, 303, 305, 307, each predictor corresponding to one of the four possible combinations of the first and second signal components $x_1$, $x_2$ and the first and second prediction signal.

Hence in the embodiment the prediction processor 101 comprises a first predictor 301 for generating a first estimate signal for the first signal component in response to the first signal component, a second predictor 303 for generating a second estimate signal for the first signal component in response to the second signal component, a third predictor 305 for generating a third estimate signal for the second signal component in response to the first signal component and a fourth predictor 307 for generating a fourth estimate signal for the second signal component in response to the second signal component.

In the embodiment, each of the predictors is a psycho-acoustic based prediction system such as a Kautz filter bank, a Laguerre filter bank, a tapped allpass line or a Gamma-tone filters. The allpass filters in the Laguerre filter bank or the tapped allpass line can be taken in accordance to a warped frequency scale resembling a psycho-acoustic relevant frequency scale such as the Barkscale or ERB scale as disclosed in Smith and Abel "Bark and ERB bilinear transform" IEEE Trans. Speech and Audio Processing, Vol. 7, pp. 697-708, 1999. In a Kautz or Gamma-tone filter bank, the filter transfers can be chosen such the center frequencies and bandwidth are qualitatively similar to those found in psycho-acoustic experiments.

For audio and speech coding purposes, the use of prediction filters associated with psycho-acoustic characteristics provides for improved quality compared to a conventional prediction algorithm based on a tapped-delay-line filtering.

The prediction processor 101 further comprises a first adder 309 (subtractor) which generates the first residual signal $e_1$ as the first signal component $x_1$ subtracted by the first estimate signal and the second estimate signal and a second adder 311 which generates the second residual signal $e_2$ as the second signal component $x_2$ subtracted by the third estimate signal and the fourth estimate signal. Hence, the residual signals $e_1$, $e_2$ corresponds to the difference between the original signal components and the combined estimates.

The transfer of the two-channel system of the prediction processor 101 may in steady-state be described by:

$$\begin{pmatrix} E_1(z) \\ E_2(z) \end{pmatrix} = \begin{pmatrix} 1 - P_{1,1}(z) & -P_{1,2}(z) \\ -P_{2,1}(z) & 1 - P_{2,2}(z) \end{pmatrix} \cdot \begin{pmatrix} X_1(z) \\ X_2(z) \end{pmatrix} \tag{5}$$

where $P_{n,m}(z)$ is the transfer function of the individual prediction filter.

As the prediction parameters for the prediction filters may be individually determined, a large number of degrees of freedom for the prediction is obtained. Specifically, no temporal assumption or association between the first and second signal components $x_1$, $x_2$ is imposed or assumed; this in contrast to the situation where a complex prediction filter is used for the complex signal $x_1+j\cdot x_2$.

Figure 4:
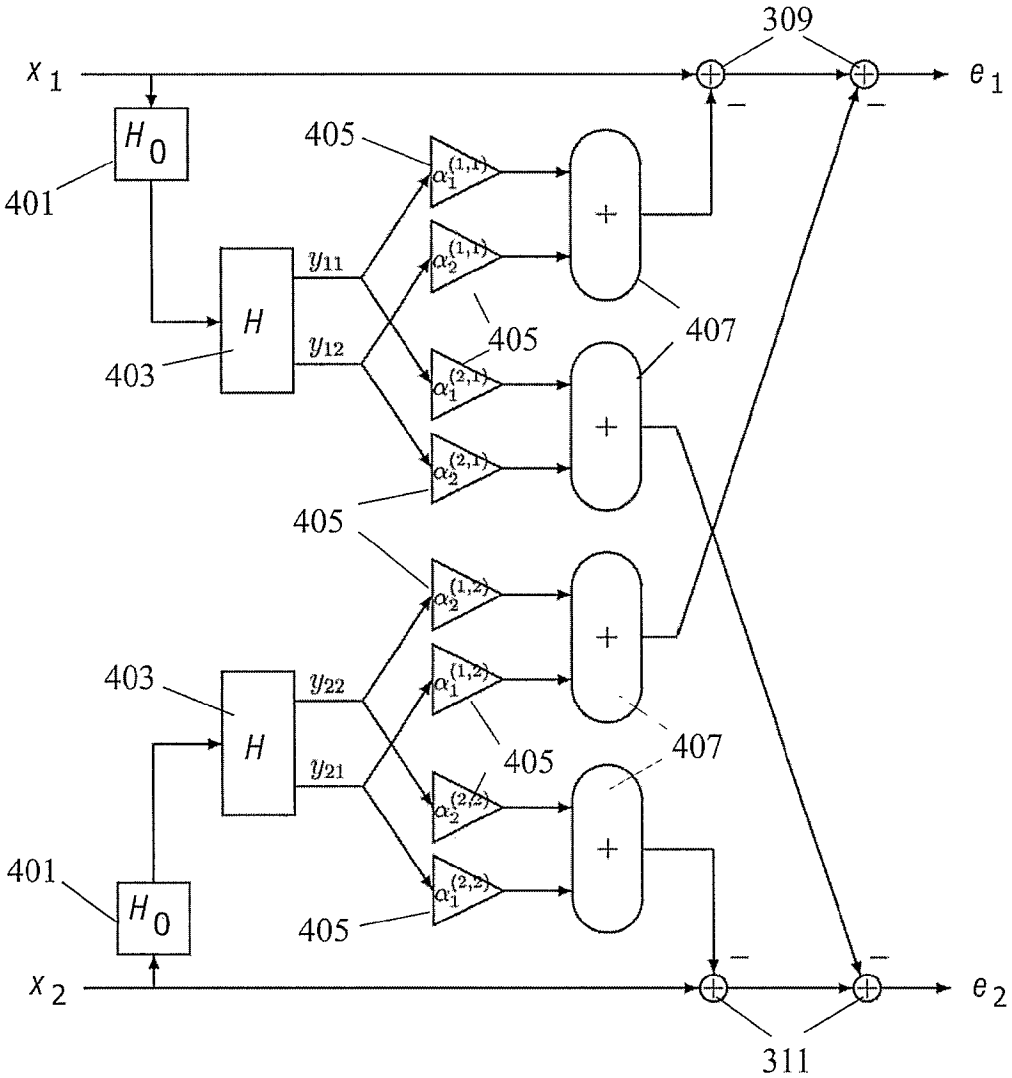
FIG. 4 illustrates an implementation of a linear prediction in an encoder in accordance with an embodiment of the invention.

A specific filter structure for the prediction filters is illustrated in FIG. 4. The transfer functions of the prediction filters of an embodiment can be written as:

$$P_{k,l} = H_0^{(k,l)} \sum_{m=1}^{M} \alpha_m^{(k,l)} \cdot H_m^{(k,l)} \tag{6}$$

i.e., as a pre-filter $H_0$ followed by a plurality of filters $H_m^{(k,l)}$ weighted by coefficients $\alpha_m^{(k,l)}$ and summed in summers.

In view of symmetry considerations, it is advantageous to take $H_0^{(k,l)}=H_0^{(l,k)}$ and $H_m^{(k,l)}=H_m^{(l,k)}$. In order to reduce complexity, we set $H_0^{(k,l)}=H_0^{(k,k)}=H_0$ and $H_m^{(k,l)}=H_m^{(k,k)}=H_m$ yielding the transfer functions $$P_{k,l} = H_0 \sum_{m=1}^{M} \alpha_m^{(k,l)} \cdot H_m \tag{7}$$

The filters $H_1$ to $H_m$ form a filter bank, denoted by H, having one input and M outputs.

Thus, in this example, the first and second signal components $x_1$, $x_2$ are each fed to a causal stable filter 401 with transfer characteristic $H_0$, which specifically may be a single delay $H_0(z)=z^{-1}$ resulting in pure linear prediction systems.

Subsequently, the output of the filters 401 are fed to a single-input multi-output (SIMO) system consisting of causal, stable, linear filters 403, for clarity illustrated in FIG. 4 as filters 403 with two outputs. Typically, the number of outputs will in practical embodiments be in the order of 20 to 50, reflecting the relevant number of degrees of freedom (bands) according to a suitable psycho-acoustical frequency scale.

Each of the outputs of the filter banks 403 are multiplied by a factor $\alpha_m^{(l,k)}$ in multipliers 405. The results are added in summers 407 to generate a (partial) prediction of the first and second signal components $x_1$, $x_2$. In particular a first estimate signal is generated for the first signal component $x_1$ based on the first signal components $x_1$ and a second estimate signal is generated for the first signal component $x_1$ based on the second signal components $x_2$. These estimate signals are subtracted from the first signal components $x_1$ to generate the first residual signal $e_1$. The symmetric processing is applied to generate the second residual signal $e_2$.

The prediction coefficients $\alpha_m^{(l,k)}$ can be determined by standard linear regression methods, i.e., by minimizing a (weighted) squared sum of the first and second residual signals $e_1$, $e_2$. The first and second signal components $x_1$, $x_2$ may be the unprocessed left and right signal from a stereo signal, but may also constitute pre-processed signals such as band-limited versions of the left and right channels.

The two-channel analysis system may ensure that the spectra of the first and second residual signals $e_1$, $e_2$ are flattened (thus equal in shape) and that the cross-correlation function associated with first and second residual signals $e_1$, $e_2$ is minimized except for a zero lag. This is a situation suitable for a rotation and the rotation processor 105 may therefore be used to construct a main and a side signal.

The optimal value of $\alpha_0$ is typically defined as that which produces a maximum of a (weighted) squared sum of the main signal and thus a minimum for the (weighted) squared sum of the side signal.

Figure 5:
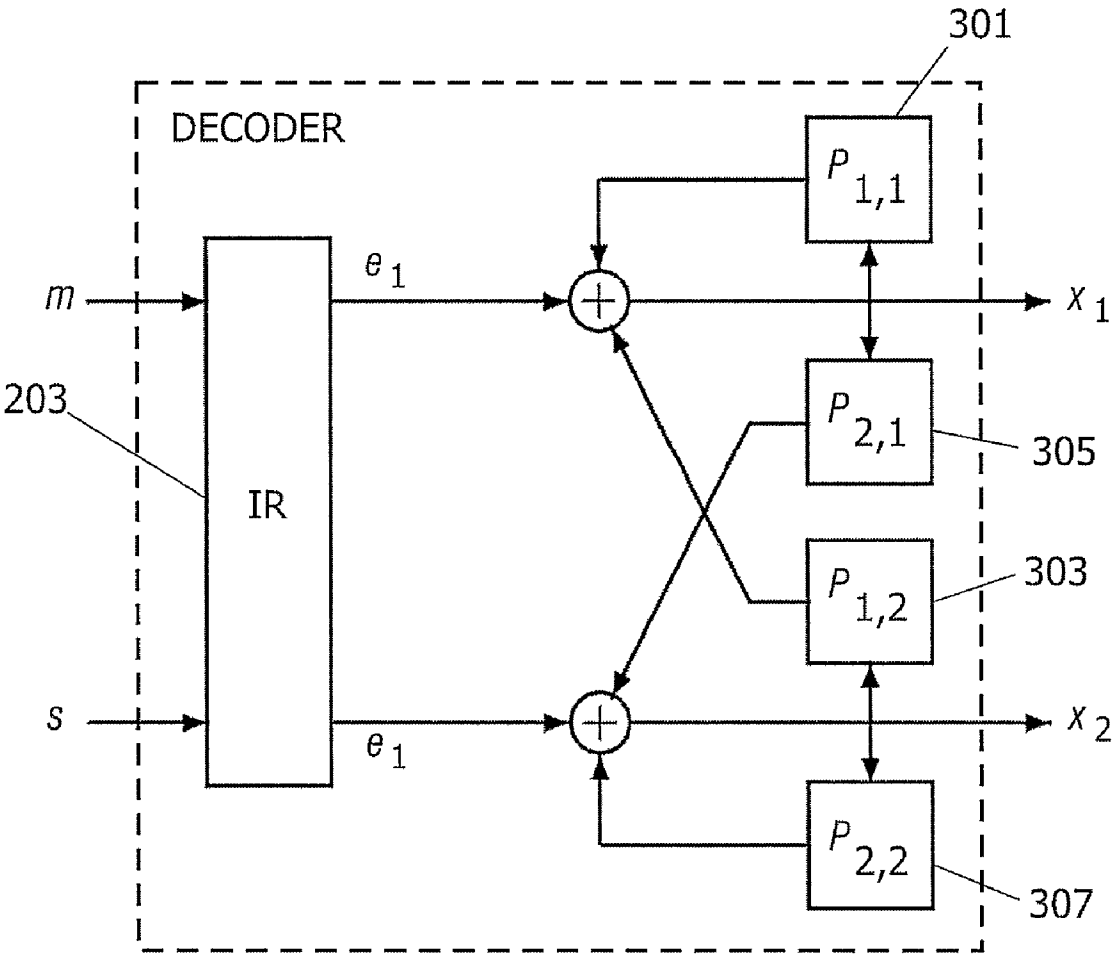
FIG. 5 illustrates an implementation of linear prediction and rotation means for a decoder in accordance with an embodiment of the invention.

The decoder 200 performs the inverse operation to that of the encoder. In particular, as illustrated in FIG. 5, the prediction decoder 207 of the decoder 200 may utilize predictors 301, 303, 305, 307 which are identical to those employed in the encoder. However, in contrast to the encoder which uses a feed-forward structure, the decoder uses a feedback structure thereby using the previously decoded signal sample to predict the current signal sample.

Figure 6:
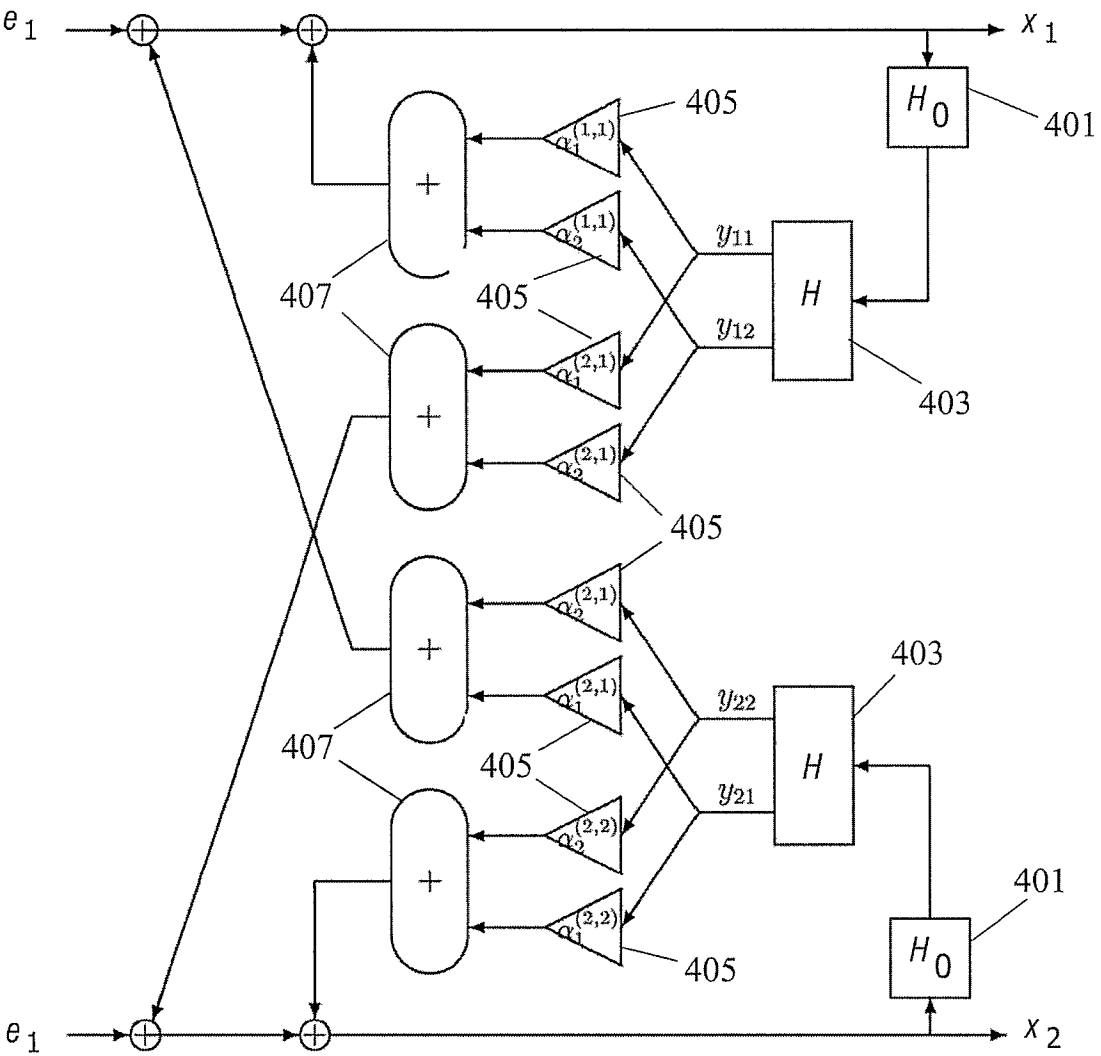
FIG. 6 illustrates an implementation of a linear prediction in a decoder in accordance with an embodiment of the invention.

More specifically, as illustrated in FIG. 6, the prediction decoder 207 of the decoder 200 may utilize the same prediction filter structure as the encoder but coupled in a feedback coupling and adding the resulting (partial) signal estimates to the residual signals $e_1$, $e_2$.

The first and second residual signals $e_1$, $e_2$ generated in this way will typically have a Gaussian distribution and a flat or white frequency spectra. Accordingly the main and side signals are also Gaussian signals having a flat frequency spectrum. However, in some embodiments, the apparatus may further comprise means for spectrally shaping the main signal and preferably the side signal in response to a spectral characteristic of the first signal component and the second signal component.

For example, an embodiment may use a mono coder for the encoding of the main signal in the encoding processor 109. In order to use a normal mono coder exploiting a psycho-acoustic model, it is preferable to have a signal with a spectral shape similar to the average spectral shapes of the first and second signal components $x_1$, $x_2$.

This may be achieved by, instead of encoding the main signal directly, using the signal $m_s$ having the z representation:

$$M_s(z) = \frac{M(z)}{H_s(z)} \tag{7}$$

where M(z) is the z-representation of the main signal. The same filtering may be applied to the side signal. With a suitable choice for $1/H_s(z)$, the average spectral envelope of the first and second signal components $x_1$, $x_2$ is restored in the encoder. This filtering can be applied before or after the rotator. Clearly, the decoder may be adapted accordingly by introducing a multiplication by $H_s(z)$.

Preferably, $H_s(z)$ meets the following two conditions:

$|1/H_s(z)|$ represents the average spectral envelope of the first and second signal components $x_1$, $x_2$.

$H_s(z)$ can be derived directly from the prediction coefficients meaning that no extra data need to be transmitted.

A theoretical possibility would be to use the filtering given by:

$$H_s(z)=\sqrt{F_{1,1}(z)\cdot F_{2,2}(z)-F_{1,2}(z)\cdot F_{2,1}(z)} \tag{8}$$

where $F_{k,1}(z)$ denotes the z representation of the filters $$F_{1,1}(z)=1-P_{1,1}(z),\ F_{2,2}(z)=1-P_{2,2}(z),$$

$$F_{1,2}(z)=-P_{1,2}(z) \text{ and } F_{2,1}(z)=-P_{2,1}(z).$$

This option is theoretical in the sense that it is unlikely that the filter $H_s(z)$ is of a finite order. Using approximations, a realizable filter is feasible and would then still be defined on the basis of the prediction coefficients only.

In the case of using the extra filter $H_s(z)$, the adaptation of the decoder is straightforward. Since, originally, the decoder implements a two-channel system with transfer function matrix:

$$(F(z))^{-1} = \frac{1}{F_{1,1}F_{2,2} - F_{1,2}F_{2,1}} \cdot \begin{pmatrix} F_{2,2}(z) & -F_{1,2}(z) \\ -F_{2,1}(z) & F_{1,1}(z) \end{pmatrix} \tag{9}$$

the decoder is accordingly modified to provide the corresponding synthesis system:

$$(F(z))^{-1} \cdot H_s(z) = \frac{H_s(z)}{F_{1,1}F_{2,2} - F_{1,2}F_{2,1}} \cdot \begin{pmatrix} F_{2,2}(z) & -F_{1,2}(z) \\ -F_{2,1}(z) & F_{1,1}(z) \end{pmatrix} \tag{9}$$

It will be appreciated that the above description for clarity has described embodiments of the invention with reference to different functional units of the storage device. However, it will be apparent that any suitable distribution of functionality between different functional units may be used without detracting from the invention. Hence, references to specific functional units are only to be seen as references to suitable means for providing the described functionality rather than indicative of a strict logical or physical structure, organization or separation. For example, the application data generator may be integrated and intertwined with the extraction processor or may be a part of this.

The invention can be implemented in any suitable form including hardware, software, firmware or any combination of these. However, preferably, the invention is implemented as computer software, stored on a computer-readable storage medium, running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with the preferred embodiment, it is not intended to be limited to the specific form set forth herein. Rather, the scope of the present invention is limited only by the accompanying claims. In the claims, the term comprising does not exclude the presence of other elements or steps. Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is no feasible and/or advantageous. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A signal encoder for encoding a multi-channel signal comprising at least a first signal component and a second signal component, the signal encoder comprising:

predicting means for generating a first residual signal of the first signal component and a second residual signal of the second signal component by linear prediction of the first signal component and the second signal component, the linear prediction being associated with psycho-acoustic characteristics;

rotation means for generating a main signal and a side signal by rotation of a combined signal comprising the first residual signal and the second residual signal, the main signal having a higher signal energy than the side signal;

first encoding means for encoding the main signal to generate encoded main data; and output means for generating an output signal comprising the encoded main data.

2. The signal encoder as claimed in claim 1, wherein said signal encoder further comprises:

second encoding means for encoding the side signal to generate encoded side data, and wherein the output means is further operable to include the encoded side data in the output signal.

3. The signal encoder as claimed in claim 2, wherein the second encoding means is operable to parametrically encode the side signal.

4. The signal encoder as claimed in claim 1, wherein the prediction means comprises at least one psycho-acoustic based filter bank.

5. The signal encoder as claimed in claim 1, wherein the rotation means is operable to rotate the combined signal to substantially maximize a signal energy of the main signal.

6. The signal encoder as claimed in claim 1, wherein the rotation means is operable to rotate the combined signal to substantially minimize a signal energy of the side signal.

7. The signal encoder as claimed in claim 1, wherein the predicting means comprises:

a first predictor for generating a first estimate signal for the first signal component in response to the first signal component;

a second predictor for generating a second estimate signal for the first signal component in response to the second signal component; and means for generating the first residual signal as the first signal component subtracted by the first estimate signal and the second estimate signal.

8. The signal encoder as claimed in claim 7, wherein the predicting means comprises:

a third predictor for generating a third estimate signal for the second signal component in response to the first signal component;

a fourth predictor for generating a fourth estimate signal for the second signal component in response to the second signal component; and means for generating the second residual signal as the second signal component subtracted by the third estimate signal and the fourth estimate signal.

9. The signal encoder as claimed in claim 1, wherein the rotation means is operable to perform a matrix multiplication on the combined signal.

10. The signal encoder as claimed in claim 1, wherein said signal encoder further comprises:

means for spectrally shaping the main signal in response to a spectral characteristic of the first signal component and the second signal component.

11. The signal encoder as claimed in claim 10, wherein the first encoding means comprises a psycho-acoustic mono encoder.

12. The signal encoder as claimed in claim 1, wherein the multi-channel signal is a stereo audio signal.

13. A signal decoder for decoding a multi-channel signal, the signal decoder comprising:

receiving means for receiving a multi-channel signal;

rotation means for generating a first residual signal and a second residual signal by rotation of the multi channel signal; and synthesis means for generating an output multi-channel signal by linear prediction in response to the first residual signal and the second residual signal, the linear prediction being associated with psycho-acoustic characteristics.

14. A method of encoding a multi-channel signal comprising at least a first signal component and a second signal component, the method comprising the steps of:

generating a first residual signal of the first signal component and a second residual signal of the second signal component by linear prediction of the first signal component and the second signal component, the linear prediction being associated with psycho-acoustic characteristics;

generating a main signal and a side signal by rotation of a combined signal comprising the first residual signal and the second residual signal, the main signal having a higher signal energy than the side signal;

encoding the main signal to generate encoded main data; and generating an output signal comprising the encoded main data.

15. A method of decoding a multi-channel signal, the method comprising the steps of:

receiving a multi-channel signal;

generating a first residual signal and a second residual signal by rotation of the multi-channel signal; and generating an output multi-channel signal by linear prediction in response to the first residual signal and the second residual signal, the linear prediction being associated with psycho-acoustic characteristics.

16. A computer-readable storage medium having a computer program recorded thereon, said computer program enabling a computer to carry out the method of encoding as claimed in claim 14.

17. A computer-readable storage medium having a computer program recorded thereon, said computer program enabling a computer to carry out the method of decoding as claimed in claim 15.

18. A computer-readable storage medium having recorded thereon a data stream comprising encoded data for a multi-channel signal, the data stream comprising:

linear prediction parameters indicative of a linear prediction of a first signal component and a second signal component of the multi-channel signal;

a rotation parameter indicative of a rotation value between a main signal and a combined signal comprising a first residual signal associated with the linear prediction of the first signal component and a second residual signal associated with the linear prediction of the second signal component; and encoded main data of the main signal.

* * * * *